United States Patent [19]

Bender

[11] Patent Number: 5,035,228

[45] Date of Patent: Jul. 30, 1991

[54] EXHAUST-GAS RECYCLING DEVICE FOR AN INTERNAL-COMBUSTION ENGINE, EPSECIALLY A DIESEL ENGINE

[75] Inventor: Franz Bender, Wendlingen, Fed. Rep. of Germany

[73] Assignee: Mercedes-Benz AG, Fed. Rep. of Germany

[21] Appl. No.: 584,924

[22] Filed: Sep. 18, 1990

[30] Foreign Application Priority Data

Sep. 23, 1989 [DE] Fed. Rep. of Germany ..... 3931812

[51] Int. Cl.[5] ..... F02M 25/07; F02D 21/08

[52] U.S. Cl. ..... 123/568

[58] Field of Search ..... 123/568, 569, 570, 571; 137/907; 251/61.5

[56] References Cited

U.S. PATENT DOCUMENTS

| | | | |
|---|---|---|---|
| 3,990,418 | 11/1976 | Nohira et al. | 123/568 |
| 4,221,204 | 9/1980 | Meyer | 123/568 |
| 4,497,335 | 2/1985 | Masuda | 123/568 X |
| 4,531,498 | 7/1985 | Bradshaw | 123/568 |
| 4,540,153 | 9/1985 | Gomi et al. | 123/568 X |

FOREIGN PATENT DOCUMENTS 2549959 5/1980 Fed. Rep. of Germany .

*Primary Examiner*—Willis R. Wolfe

*Attorney, Agent, or Firm*—Evenson, Wands, Edwards, Lenahan & McKeown

[57] ABSTRACT

In an exhaust-gas recycling device for an internal combustion engine, especially a diesel engine, in which the quantity of the recycled exhaust-gas part stream is controlled by an exhaust-gas recycling valve equipped with a diaphragm, the material of which can be destroyed above a specific temperature, a reliable closing of the valve before the critical diaphragm temperature is reached will be achieved. For this purpose, the diaphragm is loaded by a spring, the spring force of which is temperature-dependent. If the temperature dependence is to set, for example by the use of a memory material, that, in a predeterminable upper temperature range, the spring force increases with an increasing temperature, the valve can be closed to prevent diaphragm overheating in an engine-operating state in which it would still be opened per set for the recycling of exhaust gas. Not only a memory alloy, but also a bimetal or combination of these two materials is suitable as a material for a spring acting in this way.

15 Claims, 3 Drawing Sheets

EXHAUST-GAS RECYCLING DEVICE FOR AN INTERNAL-COMBUSTION ENGINE, EPSECIALLY A DIESEL ENGINE

BACKGROUND AND SUMMARY OF THE INVENTION

The invention relates to an exhaust-gas recycling device for an internal-combustion engine, especially a diesel engine, in which an exhaust-gas part stream can be returned to the combustion spaces of the engine by means of a line which can be shut off by a spring-loaded exhaust-gas recycling valve, the spring of the exhaust-gas recycling valve pressing against a diaphragm exposed to a vacuum dependent on engine-operating data, with the force directed counter to the vacuum, the valve being closed in the case of an excess of the spring force and the valve being opened ranging from partially to completely in the case of an excess of the force of the vacuum, depending on the amount of this excess.

A device of this type is known, for example, from German Patent Document DE 2,549,959 B.

The diaphragm installed in such an exhaust-gas recycling valve tolerates only a specific maximum temperature load by virtue of its material. If the admissible temperature limit is exceeded, there is the danger that the diaphragm will be damaged. This problem has hitherto been solved by setting, at any point of the engine in the engine housing, a temperature beyond which the vacuum acting on the diaphragm has been reduced, with the result that the exhaust-gas recycling valve has automatically closed under the still effective pressure of the spring. The disadvantage of this solution is that the measured temperature is merely an experimentally determined reference temperature for the temperature to be expected on the diaphragm. In this method, therefore, there is a relatively high degree of unreliability as regards a correct detection of the temperature of the diaphragm. This means, in turn, that, as a safeguard against the destruction of the diaphragm, the limiting temperature at the reference point has to be set so low that, even in the most unfavorable circumstances, the admissible temperature is not exceeded on the diaphragm itself. A measurement of the diaphragm temperature itself, so as to use this as a direct criterion for controlling or canceling the vacuum when the admissible diaphragm temperature is exceeded, involves an outlay which, as a rule, cannot be justified on economic grounds.

Starting from the above-explained background, an object on which the invention is based is to make it possible to close the exhaust-gas recycling valve at an inadmissibly high diaphragm temperature as simply as possible and in a way ensuring a complete utilization of the admissible temperature range. Furthermore, it will also be possible, at low outside temperatures, to keep the exhaust-gas valve closed even in those engine-operating states in which it would actually already have been opened as a result of the vacuum dependent on those operating data.

This object is achieved in that the force of the spring acting on the diaphragm of the exhaust-gas recycling valve is temperature-dependent.

The spring resting on the diaphragm is exposed, by way of this contact, to approximately the same temperature as the diaphragm, with the result that it is possible with high accuracy to adhere exactly to the upper limiting temperature diaphragm predetermined by virtue of its material.

Since it is mainly expedient to close the valve when and only when the upper limiting temperature which the diaphragm can tolerate is reached, it is appropriate to activate the temperature dependence of the spring only shortly before this limiting temperature is reached, whilst in the temperature range below it the spring force remains essentially unchanged.

To safeguard the diaphragm against overheating in a predetermined upper temperature range, the temperature dependence of the spring force must be designed in such a way that the spring force increases with an increasing temperature.

Moreover, for a lower temperature range the temperature dependence can be set so that, from a lower temperature limit value, the spring force likewise increases with a decreasing temperature. The last-mentioned setting is useful for starting and running up a cold engine, for example for starting an engine which is at temperature below 0 degrees Celsius. In these instances, in view of the engine-operating state it is sometimes desirable to prevent exhaust-gas recycling, even it would already have occurred per se according to the control dependent on the engine-operating conditions and usually taking place by means of a vacuum.

Under all circumstances, between an upper and a lower temperature range in which the spring force is temperature-dependent in the above-described way, there should be a middle temperature range in which the spring force remains independent of temperature, so that the valve can be controlled as a function of the engine-operating state solely by means of the vacuum applied to the diaphragm. Of course, the control dependent on the engine-operating state can also be obtained via any other control medium instead of by means of a vacuum.

The desired temperature dependence of the diaphragm spring can be achieved if the spring consists of a memory material which, as a result of material-property changes adjustable to specific temperature ranges, produces spring forces differing as a function of temperature.

Since, where memory materials are concerned, the temperature ranges in which material-property variations occur are, as a rule, relatively restricted, a plurality of spring elements consisting of differently set memory materials can be connected in series.

If a memory material is used as the diaphragm spring, it is recommended to employ a helical spring.

A temperature-dependent variation of the spring force can also be obtained by the use of bimetallic materials. The bimetallic materials here can be employed, for example, in the form of cup springs, if appropriately connected in series. The combination of a conventional helical spring of a spring force which is not temperature-dependent with bimetallic elements experiencing deformation as a function of temperature is also possible. In instances of such a combination, the bimetal should have as direct a contact with the diaphragm as possible, so as to possess temperature identity with the diaphragm. Springs made of memory material can also be combined with bimetallic elements.

Other objects, advantages and novel features of the present invention will become apparent from the following detailed description of the invention when considered in conjunction with the accompanying drawings.

DETAILED DESCRIPTION OF THE DRAWINGS

Figure 1:
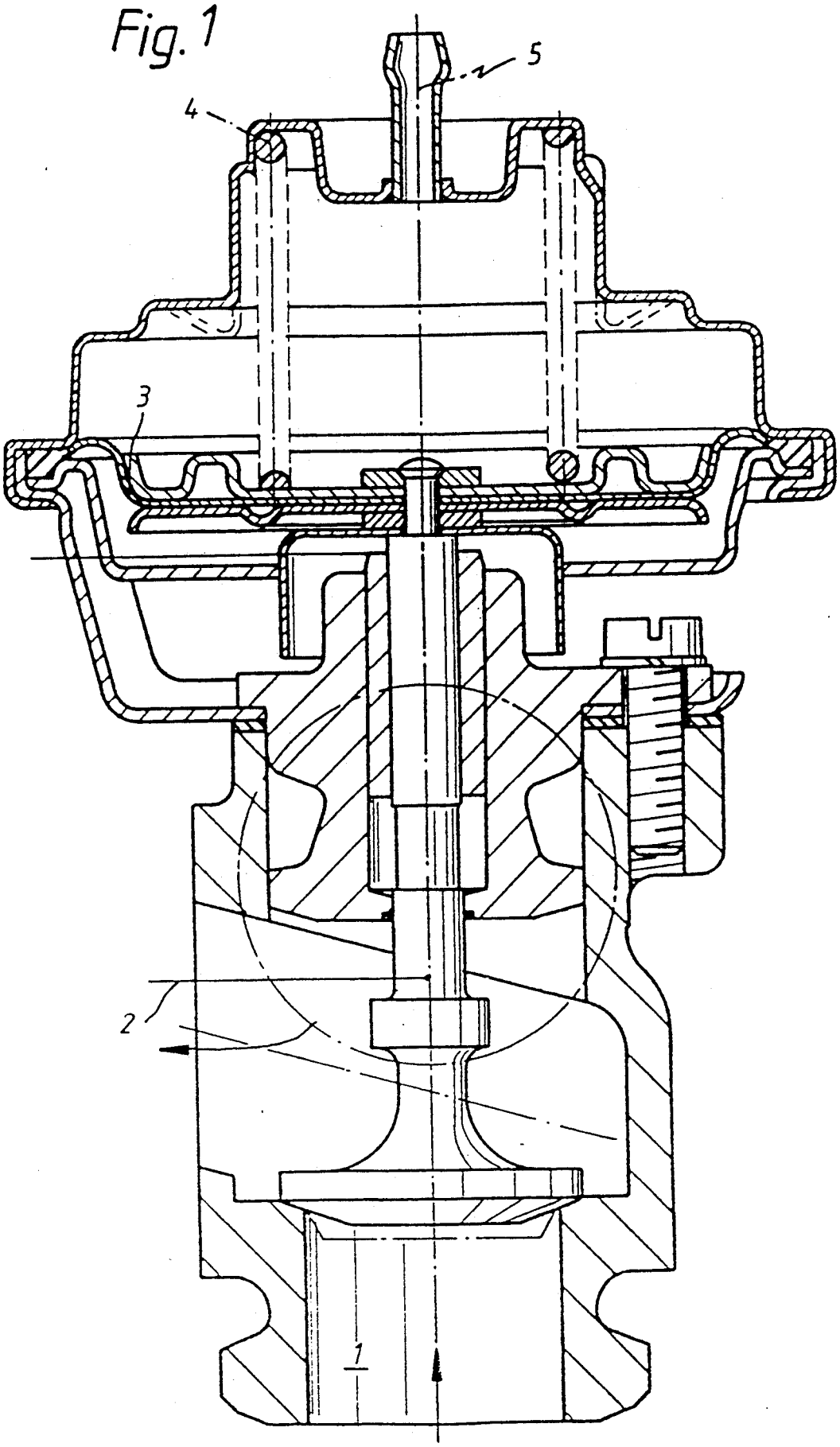
FIG. 1 shows a longitudinal section through an exhaust-gas recycling valve with a spring loading its diaphragm and consisting of memory material, constructed according to a preferred embodiment of the invention.

The recycled exhaust-gas part stream flows through the exhaust-gas recycling valve via a channel 1. The flow cross-section of this channel 1 can be varied by means of a valve tappet 2. The valve tappet 2 is connected rigidly and non-positively to a diaphragm 3. Forces act on this diaphragm 3 in opposite directions, namely on the one hand the force of a helically wound spring 4 and on the other hand the force of a vacuum 5 regulated as a function of the engine-operating state. At the same time, the force of the spring 4 acts in the direction of a closing of the valve and the force of the vacuum acts in the direction of an opening of the valve.

If a memory material is used for the helically wound spring 4, a material is employed in which an elongation of the wound spring wire with a resulting increase of the spring force occurs when a predetermined limiting temperature is exceeded which, for example, can be set at between 150 and 200 degrees Celsius, depending on the material of the diaphragm 3.

Since, in conventional memory materials, when a temperature value is exceeded an elongation does not occur abruptly, but takes place over a specific temperature range of, for example, 20 to 30 degrees, a gradual closing of the valve over that range of temperature change of the memory material is possible.

Figure 2:
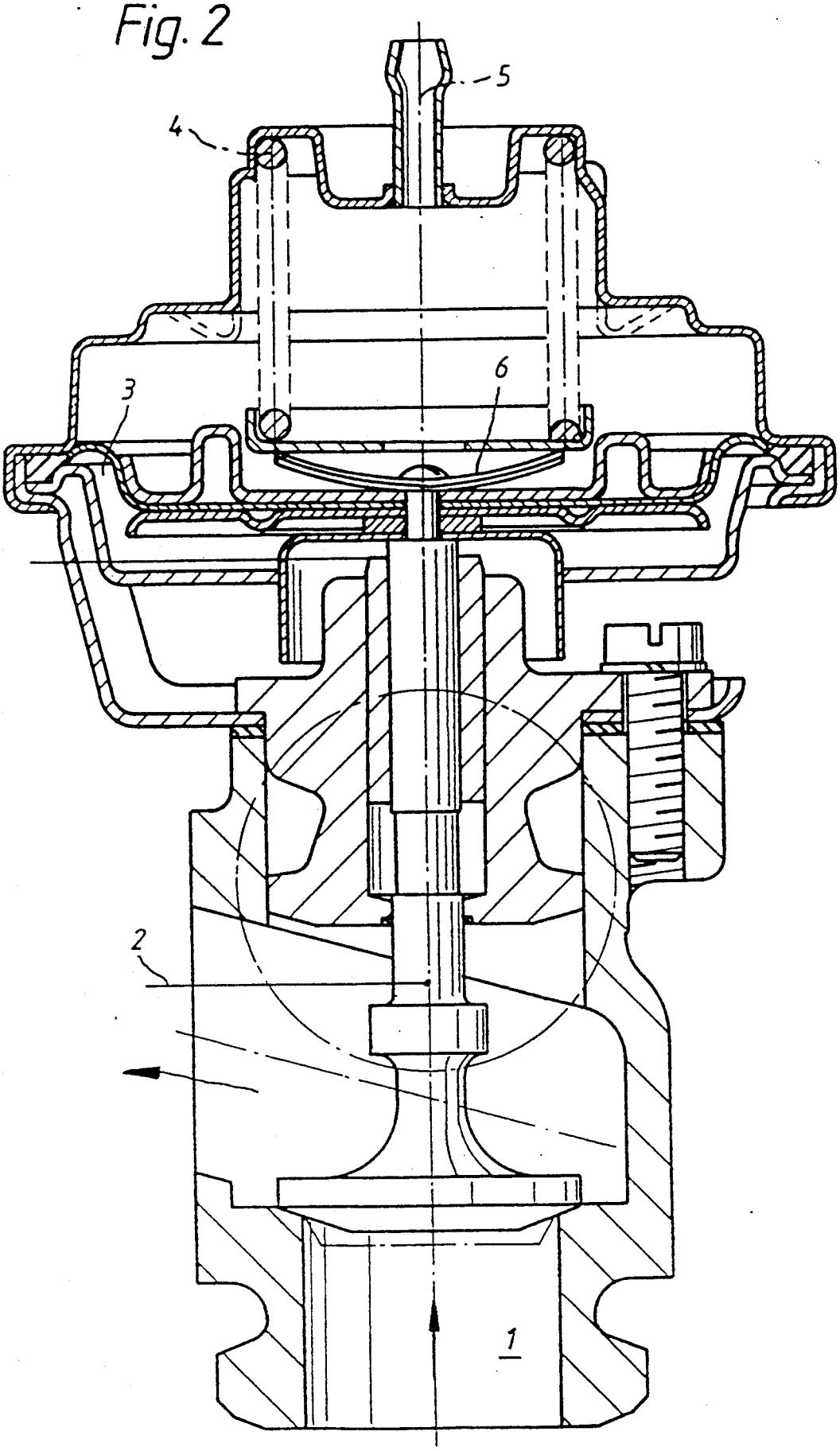
FIG. 2 shows a cutout of the diaphragm region of FIG. 1 for a combination of the diaphragm spring with a bimetallic element.

In the version according to FIG. 2, a bimetallic element 6 is inserted between the spring 4, which can consist of memory or non-memory material, and the diaphragm 3. This bimetallic element 6 curves with an increasing temperature and thereby causes reduction of the clamping length of the spring 4, which in turn results in an increases of the spring force acting on the diaphragm 3.

If it is intended, at cold engine temperatures, to obtain a closing of the exhaust-gas recycling valve which ignores the vacuum at the diaphragm 3, the bimetallic element 6 must simply be designed so that, at a correspondingly low temperature, it keeps the clamping length of the spring 4 smaller than at a higher temperature.

Figure 3:
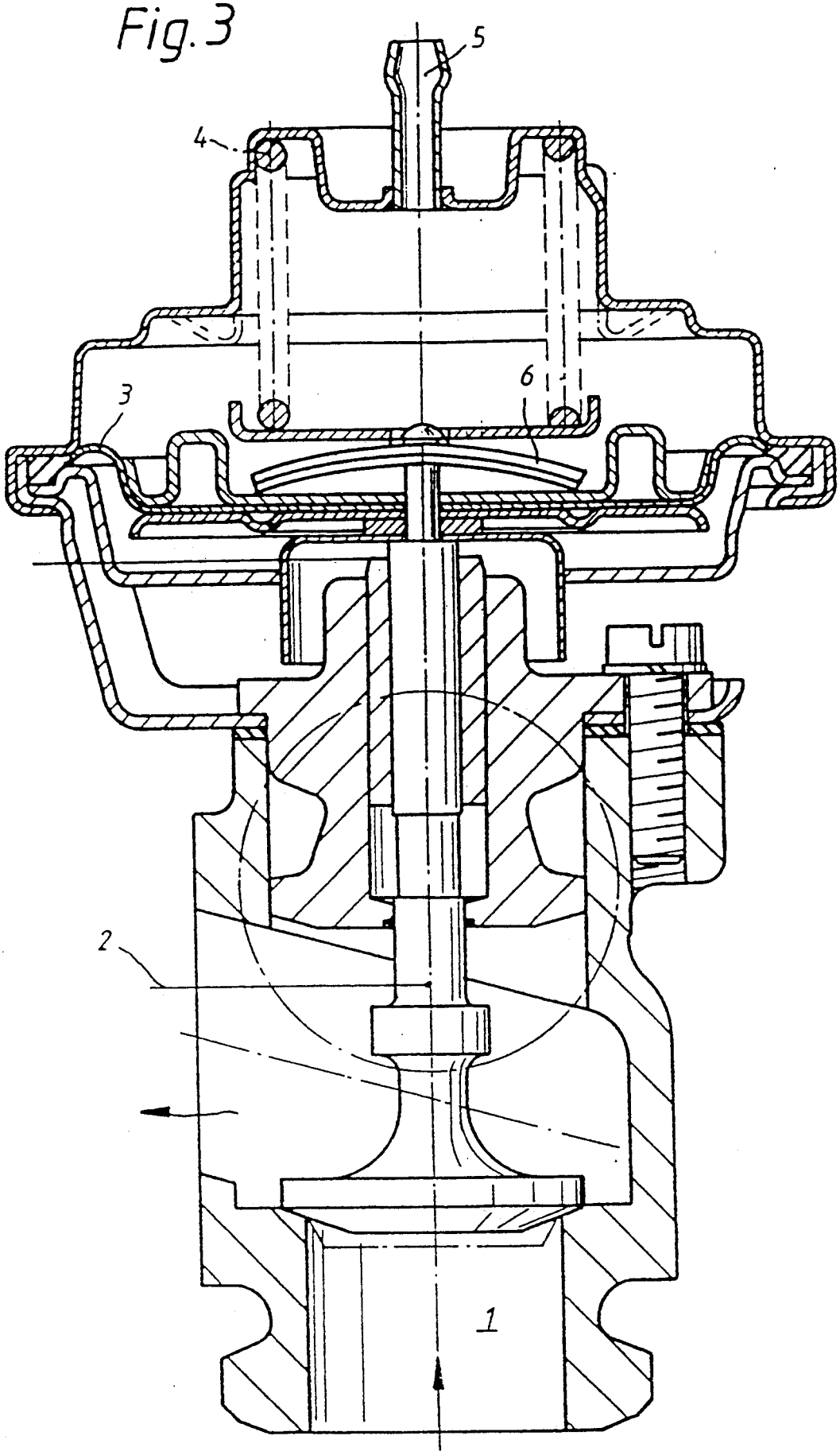
FIG. 3 shows an alternative version of the use of a bimetallic element according to FIG. 2.

With a design of the bimetallic element 6 according to FIG. 3, an increase of the spring force can be obtained only beyond a predetermined temperature. For this purpose, the spring 4 is first brought to bear in the neutral region of the bimetallic element 6 not experiencing deformation, whilst the region of the bimetal undergoing deformation still has initially no contact with the spring 4. After the predetermined temperature value is reached, the region of the bimetallic element 6 experiencing deformation then comes in contact with the spring 4 and thereafter reduces the clamping length of the spring 4 in response to a further temperature rise, in order thereby to initiate the spring-force increase desirable in a fixed upper temperature range.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Exhaust-gas recycling device for an internal-combustion engine, especially a diesel engine, in which an exhaust-gas part stream can be returned to the combustion spaces of the engine by means of a line which can be shut off by a spring-loaded exhaust-gas recycling valve, the spring of the exhaust-gas recycling valve pressing against a diaphragm exposed to a vacuum dependent on engine-operating data, with the force directed counter to the vacuum, the valve being closed in the case of an excess of the spring force and the valve being opened ranging from partially to completely in the case of an excess of the force of the vacuum, depending on the amount of this excess, wherein the force of the spring acting on the diaphragm is temperature-dependent.

2. Exhaust-gas recycling device according to claim 1, wherein the temperature dependence of the spring is restricted to specific temperature ranges.

3. Exhaust-gas recycling device according to claim 1, wherein the spring is exposed to the influence of the temperature of the diaphragm.

4. Exhaust-gas recycling device according to claim 1, wherein the spring force increases above a predeterminable temperature.

5. Exhaust-gas recycling device according to claim 1, wherein the spring force increases below a predeterminable temperature.

6. Exhaust-gas recycling device according to claim 1, wherein the spring force increases in a lower and an upper temperature range and remains essentially constant in a wide intermediate range.

7. Exhaust-gas recycling device according to claim 1, wherein the spring consists of memory material which, with the same clamping length, exerts different spring forces at different temperatures.

8. Exhaust-gas recycling device according to claim 1, wherein the spring is composed of a plurality of elements connected in series and consisting of memory materials of differing set temperature behavior.

9. Exhaust-gas recycling device according to claim 1, wherein the spring interacts with bimetallic elements or is formed from these.

10. Exhaust-gas recycling device according to claim 2, wherein the spring is exposed to the influence of the temperature of the diaphragm.

11. Exhaust-gas recycling device according to claim 10, wherein the spring force increases above a predeterminable temperature.

12. Exhaust-gas recycling device according to claim 10, wherein the spring force increases below a predeterminable temperature.

13. Exhaust-gas recycling device according to claim 6, wherein the spring consists of memory material which, with the same clamping length, exerts different spring forces at different temperatures.

14. Exhaust-gas recycling device according to claim 10, wherein the spring consists of memory material which, with the same clamping length, exerts different spring forces at different temperatures.

15. Exhaust-gas recycling device according to claim 14, wherein the spring is composed of a plurality of elements connected in series and consisting of memory materials of differing set temperatures behavior.

* * * * *